US009074410B2

(12) United States Patent
Martinez

(10) Patent No.: US 9,074,410 B2
(45) Date of Patent: Jul. 7, 2015

(54) TASSEL FOR BLIND CORDS

(71) Applicant: Juan José Borras Martinez, Valencia (ES)

(72) Inventor: Juan José Borras Martinez, Valencia (ES)

( * ) Notice: Subject to any disclaimer, the term of this patent is extended or adjusted under 35 U.S.C. 154(b) by 0 days.

(21) Appl. No.: 14/166,800

(22) Filed: Jan. 28, 2014

(65) Prior Publication Data

US 2014/0208544 A1 Jul. 31, 2014

(51) Int. Cl.
*B25G 1/04* (2006.01)
*E06B 9/326* (2006.01)

(52) U.S. Cl.
CPC ..... *E06B 9/326* (2013.01); *Y10T 16/4724* (2015.01); *E06B 2009/3265* (2013.01)

(58) Field of Classification Search
USPC ..... 16/422, 428; 24/115 F, 265 EC
See application file for complete search history.

(56) References Cited

U.S. PATENT DOCUMENTS 3,364,500 A * 1/1968 Fox ..... 2/150
5,504,977 A * 4/1996 Weppner et al. ..... 24/115 R
5,906,233 A * 5/1999 May ..... 160/178.1 R
6,044,527 A * 4/2000 Ishida et al. ..... 24/129 R
7,377,128 B1 * 5/2008 Zucker-Pinchoff ..... 63/3.1
7,441,917 B1 * 10/2008 Underdown et al. ..... 362/103
7,587,794 B2 * 9/2009 Lin ..... 24/115 F
7,802,448 B2 * 9/2010 Chan ..... 63/3.1
2009/0241295 A1 * 10/2009 Zhang ..... 24/115 F
2011/0108216 A1 * 5/2011 Levin ..... 160/340
2011/0108217 A1 * 5/2011 Levin ..... 160/340

FOREIGN PATENT DOCUMENTS

ES 1073373 U 1/2013

* cited by examiner

*Primary Examiner* — Roberta Delisle
(74) *Attorney, Agent, or Firm* — John Alumit

(57) ABSTRACT

This tassel comprises at least a first piece and a second piece, both independent, and attached to respective free ends of operating cords for blinds; and present on the facing surfaces are magnetically attracted first halves and second halves suitable for establishing a retention of tassel parts in a mounting position, to allow said parts of the tassel to separate when a force superior to the force of the magnetic attraction of said first and second halves is applied between the two cords; characterized in that the magnetically attracted first halves are mounted in a protruding position with respect to the surface of said first part.

1 Claim, 2 Drawing Sheets

TASSEL FOR BLIND CORDS

CROSS-REFERENCE TO RELATED APPLICATION

This application is a national application and claims the benefit of the priority filing date in Spanish patent application no. U201330085 filed on Jan. 28, 2013. The earliest priority date claimed is Jan. 28, 2013.

FEDERALLY SPONSORED RESEARCH

Not Applicable

SEQUENCE LISTING OR PROGRAM

Not Applicable

BACKGROUND

This invention relates to a tassel for blind cords, used to temporarily hold together the free ends of operating blind cords; the tassel comprises at least one first piece and a second piece, both independent and attached to the respective free ends of operating blind cords, and disposed on the surfaces facing each other, are magnetically attracted first halves and second halves suitable for establishing a retention of the tassel parts in a mounting position, and for allowing separation of the mentioned tassel parts when a force exceeding the magnetic attraction of said first and second halves applies between the two strings.

This tassel for blind cords has structural features directed to simplifying the manufacturing process of the tassel in question and for allowing the very means of magnetic attraction that establishes a link and balance of the tassel parts, making it unnecessary to use additional elements to obtain these functions.

FIELD OF APPLICATION OF THE INVENTION

This invention is applicable in the manufacturing of tassels for blind cords, especially Venetian Blinds, Roman Shades and other similar elements operated by cords.

BACKGROUND OF THE INVENTION

At present, it is usual for Venetian blinds, Roman Shades and other similar items to have two or more cords for its manual operation, and operated simultaneously in order to get vertical displacement of the curtain or Roman Shade towards a position of opening or closing.

The free ends of these cords hang from one of the sides of the blind, being normal that said ends pass through a tassel or similar and that are fixed together by a knot, leaving the knot hidden by the tassel in question.

This knot determines that the free ends of the cords define at its lower end a closed loop that carries a risk of injury by hanging or strangulation, especially for young children playing with the blind cords.

To solve this problem the same applicant of the present invention developed in his day a tassel for operating cords described in the application for utility model U20100919, with Publication Number ES1073373U.

Said knob includes two independent parts that define other portions of the tassel perimeter, and show on the facing surfaces: complementary protrusions for proper well balance in a mounting position, magnetic halves for retention in that mounting position and separation of both pieces when a force greater than the attraction force of said magnetic halves is applied between the cords, and channels for placing the free ends of the cords and their fastening with the respective tassel parts.

These features allow a fully satisfactory solving of the set out problem, as by applying a force on the loop formed by the cords, for example, by hanging by the neck, overcomes the magnetic attraction force that holds together the two pieces of the tassel, causing said parts to fall apart, being hanged up from the respective free ends of the cords, with a consequent opening of the loop, to avoid the risk of hanging or strangulation.

However, this tassel shows manufacturing disadvantages. Since the magnetic halves in the pieces forming part of the tassel are built-in, and the definition in said complementary protrusion pieces centers the coupling position, this dictates that said parts have some constructive complexity and require certain handling to assemble the magnetic halves, which increases the final cost of the tassel.

SUMMARY

A tassel for blind cords comprising a first piece and a second piece, both independent and attached to the respective free ends of operating cords for blinds; and present on the facing surfaces are magnetically attracted first halves and second halves suitable for establishing a retention of tassel parts in a mounting position, to allow said parts of the tassel to separate when a force superior to the force of the magnetic attraction of said first and second halves is applied between the two cords; characterized in that the magnetically attracted first halves are mounted in a protruding position with respect to the surface of said first part.

DRAWINGS

To complement the description, and in order to facilitate the understanding of the invention features, the present specification is accompanied by a set of drawings.

DESCRIPTION

Figure 1:
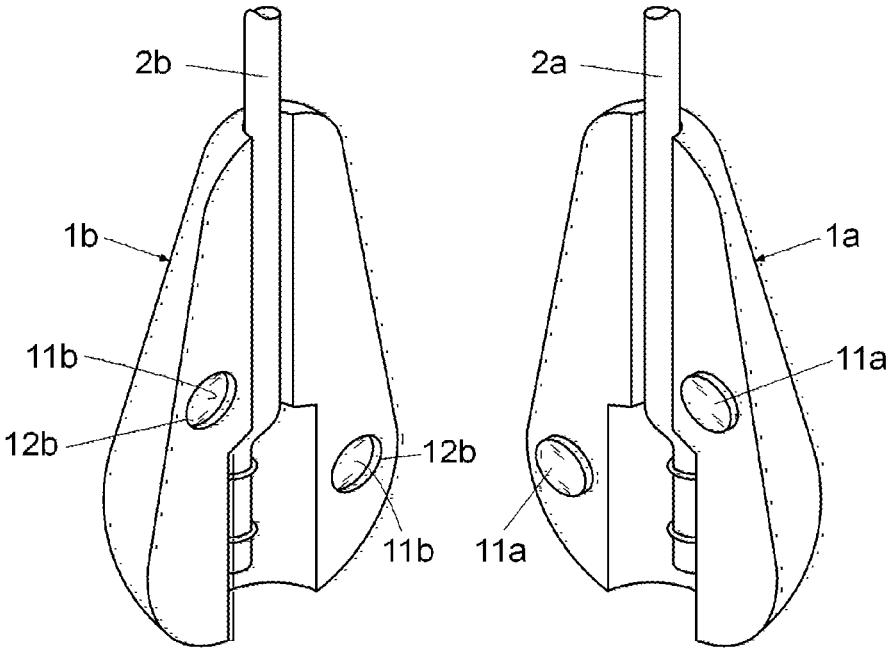
FIG. 1 shows a perspective view of a working example of a tassel for blind cords, according to the invention, made with two parts fixed to the respective free ends of two operating cords of a blind; the mentioned separate parts are shown.
Figure 2:
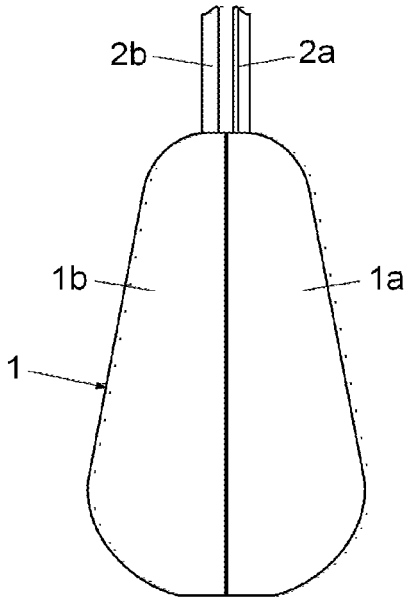
FIG. 2 shows an elevation view of the tassel of the preceding figure in a mounting position and joined by the action of the magnetically attracted halves.
Figure 3:
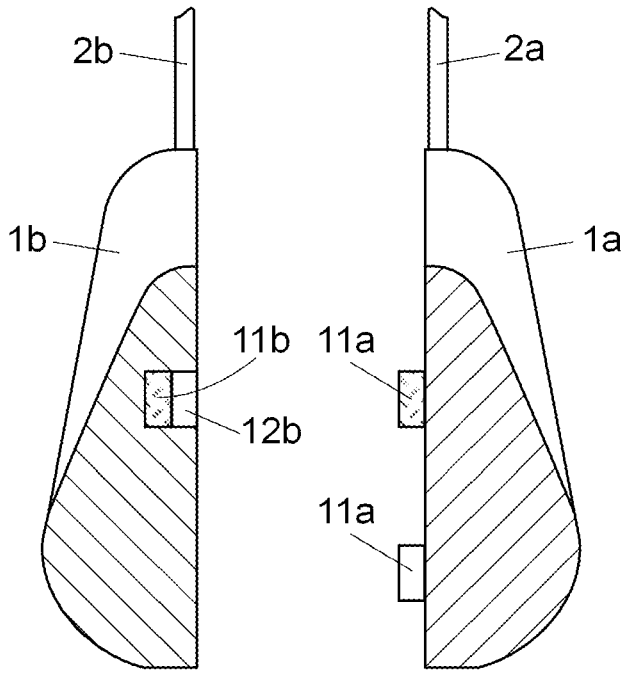
FIG. 3 shows a view of the two constitutive parts of the tassel, facing each other, spaced apart and sectioned by a vertical plan passing through the area the magnetic attraction halves assembly.

The blind cord tassel, which is the object of this invention, is based on the tassel previously identified in the background, and is formed by at least a first piece and a second piece, both independent and attached to the respective free ends of blind operating cords, and present on the facing surfaces of these parts are magnetically attracted first halves and second halves that establish a retention of the tassel parts in a mounting position and that allows for separation of these halves by way of applying a higher force between the two cords than the magnetic attraction force between said first and second halves; it demonstrates constructive features directed to simplifying the manufacturing and the geometry of the constitutive parts of the tassel, thereby lowering the final product cost.

To that end, and according to the invention, the first magnetically attractive halves are assembled in a protruding position with regards to one first piece of the tassel surface; meanwhile the magnetic attractive second halves are disposed on the bottom of clear-cut holes on the facing surface of the tassel second half; presenting said holes with a depth equal to or greater than the sum of the heights of the facing parts of the tassel magnetically attractive halves.

The holes of the second piece of the tassel and the magnetically attractive first halves, protruding from the first piece of the tassel, form complementary halves that couple and balance the first and second piece of the tassel in the assembling position of said tassel.

This feature provides that the mentioned holes in the second piece of the tassel and the magnetically attractive first halves of the first piece of the tassel establish a centering of both parts of the tassel in the assembled position, making unnecessary the definition on these parts of specific halves and additional means for centering said pieces in the tassel assembly position.

This way a higher simplicity in the manufacturing of the pieces and consequently a reduction of the final cost of the tassel can be obtained.

The magnetically attractive first and second halves can be formed by two magnet sets with facing opposite polarities, or by a set of magnets and a set of ferromagnetic pieces, as this does not substantially affect the invention.

The setting of the magnetically attractive first halves in a protruding position with regards to the first piece of the tassel provides that the mentioned first halves are set on the surface of that first piece, without having to define in the same seat or recess mounting. This means that it is enough to define holes in the second piece with an appropriate depth to have the magnetically attractive second halves in its bottom, and that in the inside, a length sufficient to house the magnetically attractive first halves remains free when the tassel is assembled.

In the illustrated example of the preferred embodiment, the tassel contains a first part (1*a*) and a second part (1*b*) attached to the free ends of the respective operating cords (2*a* and, 2*b*) of a blind.

Parts (1*a* and 1*b*) present on the facing surfaces on which are disposed in mutually opposite positions magnetically attractive first halves (11*a*) and second halves (11*b*), in this case constituted by respective pairs of magnets.

The first halves (11*a*) are mounted in a protruding position with respect to the surface of the first piece (1*a*), while the second halves (11*b*) are housed in the bottom of some holes (12*b*) defined on the surface facing the second part (1*b*).

Figure 4:
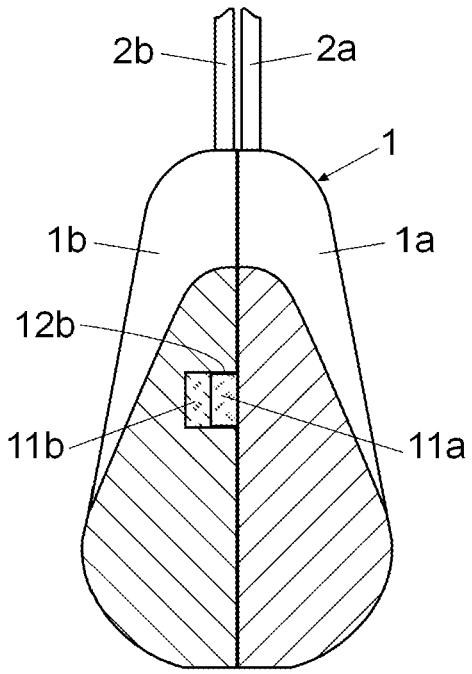
FIG. 4 shows a view similar to FIG. 3, with the two parts in an assembled position of the tassel.

These holes have a depth equal to the sum of the heights of the magnetically attractive first and second halves (11*a*, 11*b*), so that in the coupling position of the parts (1*a*, 1*b*), the first magnetically attractive halves (11*a*) of the first part (1*a*) are housed in the holes (12*b*) of the second piece (1*b*) acting as a centering of parts (1*a* and 1*b*) as shown in FIG. 4.

Having sufficiently described the nature of the invention, as well as an example of preferred embodiment, we state for all appropriate purposes that the materials, shape, size and arrangement of the elements described can be modified, provided that this does not alter the essential features of the invention claimed below.

The following is claimed:

1. A tassel for blind cords, comprising at least a first piece (1*a*) and a second piece (1*b*), both independent and attached to respective free ends of operating cords (2*a*, 2*b*) for blinds; and disposed on facing surfaces of said first piece and second piece are magnetically attracted first halves (11*a*) and second halves (11*b*) suitable for establishing a retention of said first piece and second piece (1*a*, 1*b*) of the tassel (1) in a mounting position, to allow for separation of said parts (1*a*, 1*b*) of the tassel (1) when a force greater than the force of the magnetic attraction of said first and second halves (1*a*, 1*b*) is applied between the two cords (2*a*, 2*b*); wherein:

the magnetically attractive first halves (11*a*) are mounted in a protruding position with respect to the surface of said first piece (1*a*);

the magnetically attractive second halves (11*b*) are arranged at a bottom of holes (12*b*) defined on the facing surface of the second piece (1*b*), said holes (12*b*) having a depth equal to or greater than the sum of the heights of the magnetically attractive first halves and second halves (11*a*, 11*b*); and the holes (12*b*) of the second piece and the first halves (11*a*) of the first piece come into direct contact with each other so that the first halves (11*a*) of the first piece are inserted inside the holes (12*b*) of the second piece to form a complementary means of coupling and centering on the tassel's first and second piece (1*a*, 1*b*) in the mounting position of said tassel.

* * * * *